US005350039A

United States Patent [19]

Voss et al.

[11] Patent Number: 5,350,039

[45] Date of Patent: Sep. 27, 1994

[54] LOW CAPACITY CENTRIFUGAL REFRIGERATION COMPRESSOR

[75] Inventors: Mark G. Voss, Brighton; William O. Harvey, Cadillac, both of Mich.

[73] Assignee: Nartron Corporation, Reed City, Mich.

[21] Appl. No.: 23,053

[22] Filed: Feb. 25, 1993

[51] Int. Cl.[5] ..... F01M 1/00

[52] U.S. Cl. ..... 184/6.16; 184/6.26; 184/104.1; 62/469; 62/505; 415/110

[58] Field of Search ..... 184/6.16, 6.26, 104.1, 184/55.1, 104.1, 6.18; 62/469, 505; 418/902; 415/110, 111, 112

[56] References Cited

U.S. PATENT DOCUMENTS 2,266,107 12/1941 Waterfil ..... 62/469
3,912,044 10/1975 Schindelhauer ..... 184/6.16
4,717,316 1/1988 Muramatsu et al. ..... 184/6.16
5,087,170 2/1992 Kousokabe et al. ..... 184/6.16
5,224,845 1/1993 Mangyo et al. ..... 184/6.16

FOREIGN PATENT DOCUMENTS 0345919 12/1989 European Pat. Off. ..... 184/6.16
2201399 7/1973 Fed. Rep. of Germany ..... 184/6.16

*Primary Examiner*—Thomas E. Denion
*Attorney, Agent, or Firm*—C. J. Fildes & Co.

[57] ABSTRACT

An improved motor driven centrifugal refrigerant compressor is disclosed having a housing enclosing a motor, control electronics and moving parts of the compressor, and a fluid pathway for circulating a mixture of low pressure refrigerant and a lubricant around the pathway, the pathway including a lubricant concentrator for coalescing the lubricant of the mixture to lubricate moving parts of the compressor and the pathway also including a convective heat transfer region to cool the motor and control electronics within the housing.

6 Claims, 10 Drawing Sheets

LOW CAPACITY CENTRIFUGAL REFRIGERATION COMPRESSOR

TECHNICAL FIELD

This invention relates to electrically powered refrigeration compressors for use in vapor-cycle type air cooling systems for mobile or stationary applications and more particularly to a motor driven refrigerant compressor that circulates a lubricant/refrigerant mixture through a fluid pathway within the compressor to lubricate the moving parts and cool the motor and control electronics as the mixture is circulated.

BACKGROUND ART

Conventional refrigeration equipment in the 1–3 ton cooling class relies on positive displacement compressors as they are most efficient at low output shaft speeds. This low speed is tailored to applications such as automobiles where belt drive running sheaves in excess of 8,000 RPM are uncommon, and to commercial appliances where 60 Hz commercial power make shaft speeds in excess of 3,500 RPM impossible without brushes or gearboxes.

In order to keep this equipment as small as possible, the compressor displacement has to be kept as small as possible. This practice, in general, minimizes production costs. In concert, a small displacement compressor requires the use of a high pressure, high density refrigerant in order to pump a sufficient mass flow of refrigerant to produce the desired refrigeration effect.

These conventional refrigerant compressors contain an oil sump or reservoir as part of the compressor housing. Lubricating oil is pumped from the reservoir to the compressor's bearings. Examples of such systems can be found in U.S. Pat. Nos. 3,449,922 and 4,213,307. However, in these centrifugal compressors, the refrigerant is isolated from the lubricant. This approach requires seals between the lubrication system and the refrigeration system to isolate the oil from the refrigerant, a separate pump for circulating lubricant to moving parts and a complex mechanism to separate oil that leaks into the refrigerant.

Disclosure Of Invention

An object of the present invention is to provide an improved electrically powered centrifugal compressor utilizing an internal refrigerant flowpath circulating a mixture of lubricant and refrigerant to lubricate and cool the centrifugal compressor.

Another object of the present invention is to redistribute the lubricant to alter the concentration of lubricant within a portion of the mixture and circulating that portion to the moving parts within the compressor.

It is another object of the present invention to provide an electrically driven two stage centrifugal compressor for a cooling system that eliminates the need to isolate a lubricant from a refrigerant.

Another object of the present invention is to provide improved cooling for control electronics that control the electrical power source for the compressor by communicating the refrigerant mixture about the motor and control electronics.

It is another object of the present invention to reduce the cost of a centrifugal compressor by eliminating the need for a separate lubrication system and the pump for such a system.

In carrying out the above objects and other objects of the invention, an improved motor driven centrifugal compressor has a housing enclosing the motor and moving parts of the compressor. A refrigerant mixture is circulated around a refrigerant loop in the compressor housing. The refrigerant mixture includes lubricant and refrigerant that circulates through the housing lubricating the motor and moving parts as the mixture is circulated.

Control electronics for the motor are mounted within the housing and in communication with the refrigerant loop. The control electronics are thereby cooled by the circulating refrigerant mixture. The refrigerant mixture comprises a refrigerant of at least 90% of the mixture's volume and a lubricant of at least 1% of the mixture's volume. Preferably, the refrigerant is low pressure refrigerant having a boiling point in the range of 70° to 150° F. at standard atmospheric pressure and the lubricant is transported by the host refrigerant.

Preferably, the motor is an electronically commutated brushless DC motor including carbon graphite filament windings as a means of rotor magnet retention. The preferred compressor is a two-stage centrifugal compressor having the motor mounted between the two stages.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
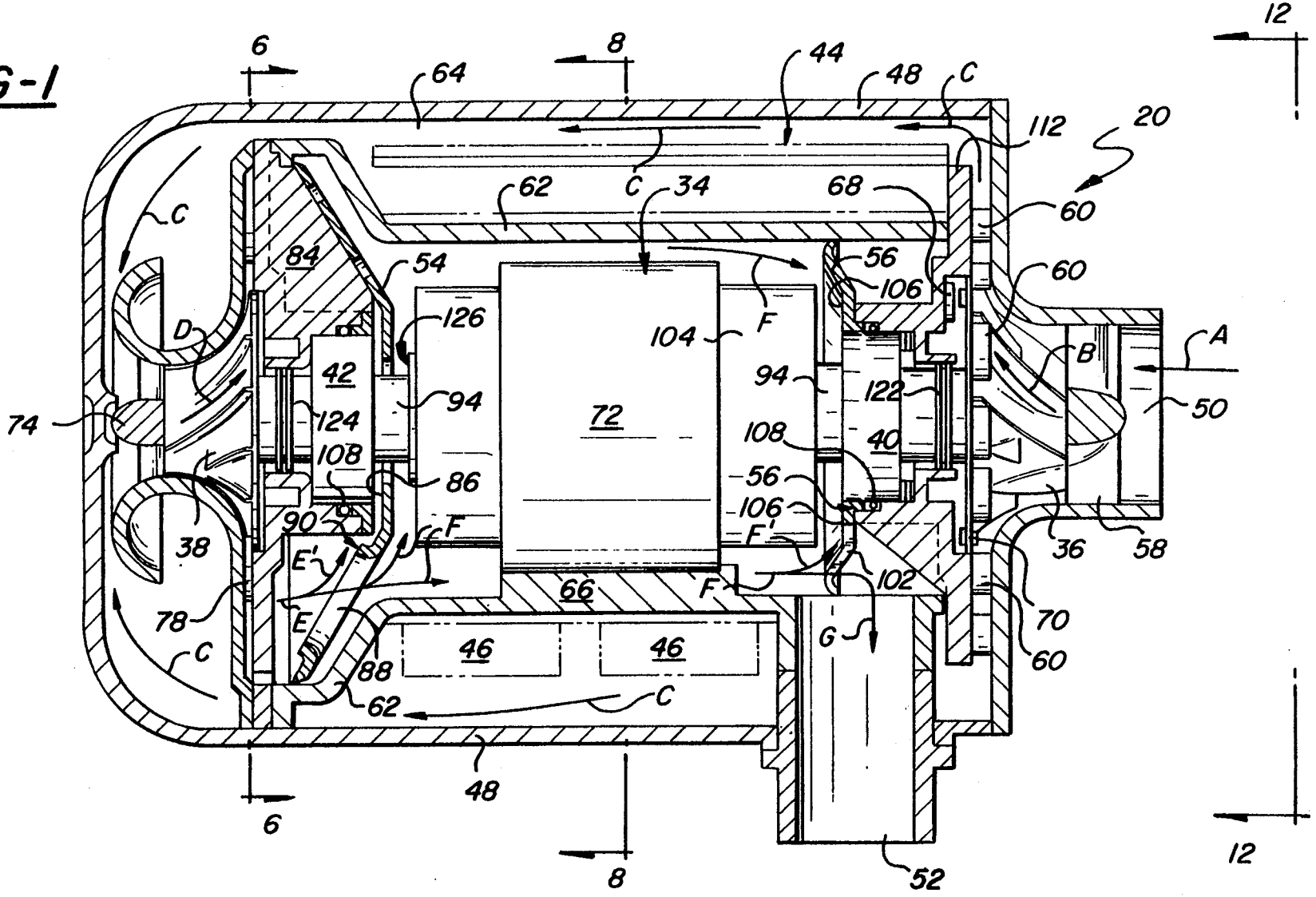
FIG. 1 is a diagrammatic cross-sectional view of a two stage centrifugal compressor constructed in accordance with the present invention.
Figure 3:
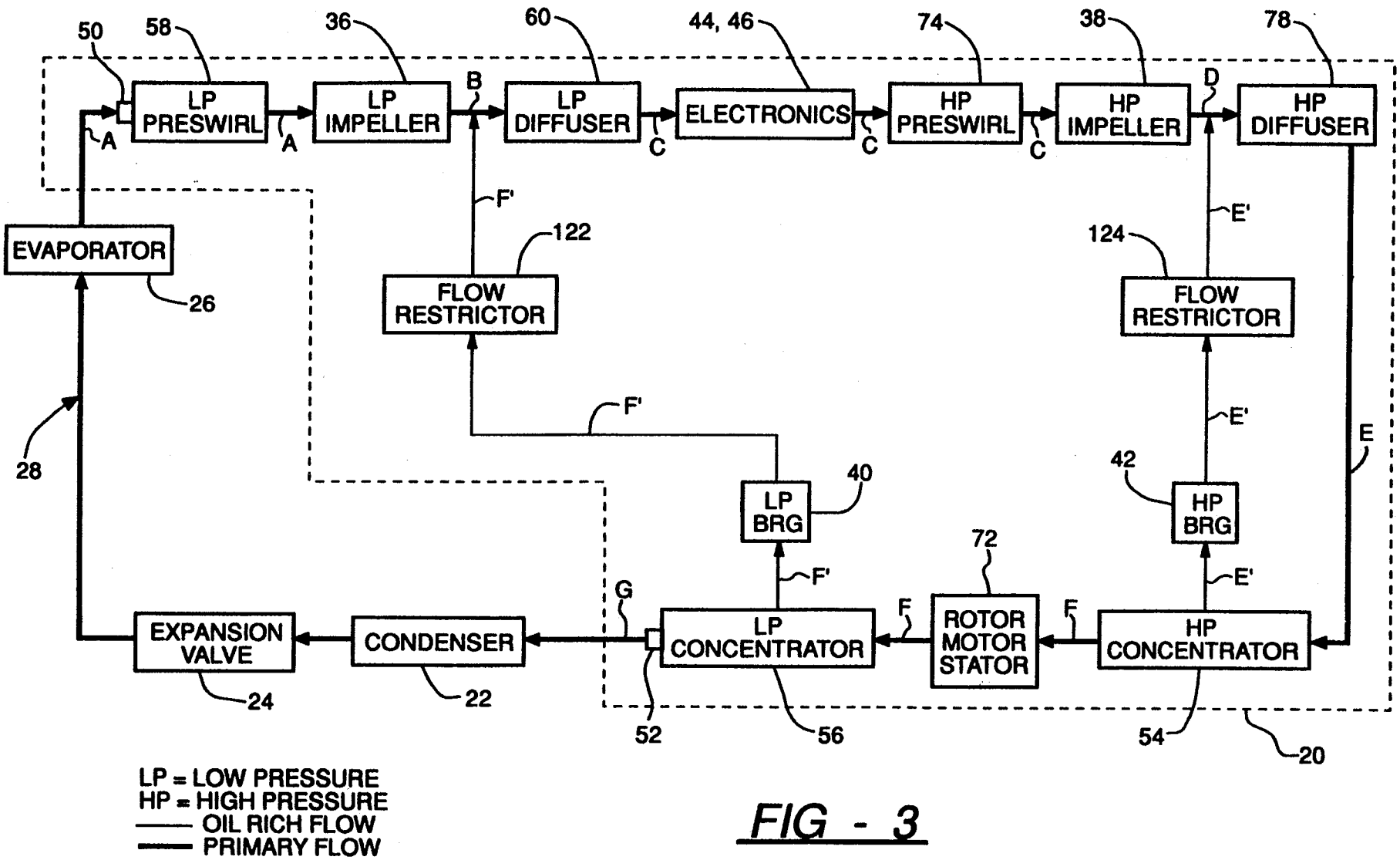
FIG. 3 is a more detailed block diagram of the system in FIG. 2.

Referring to FIG. 1 of the drawings, a low capacity centrifugal refrigeration compressor constructed in accordance with the present invention is generally indicated by reference numeral 20 and is used in a vapor-cycle type air cooling system shown in FIG. 20 As is hereinafter more fully described, compressor 20 utilizes a low pressure refrigerant having a boiling point in the range of 70° to 150° F. at standard atmospheric pressure in combination with a lubricant in the refrigerant to lubricate and cool the compressor as the refrigerant mixture is circulated through a refrigerant pathway in the compressor. The refrigerant pathway is illustrated in FIG. 3 and is hereinafter described with reference to circulation of the refrigerant mixture through pathways referred to by letters A–G.

Figure 2:
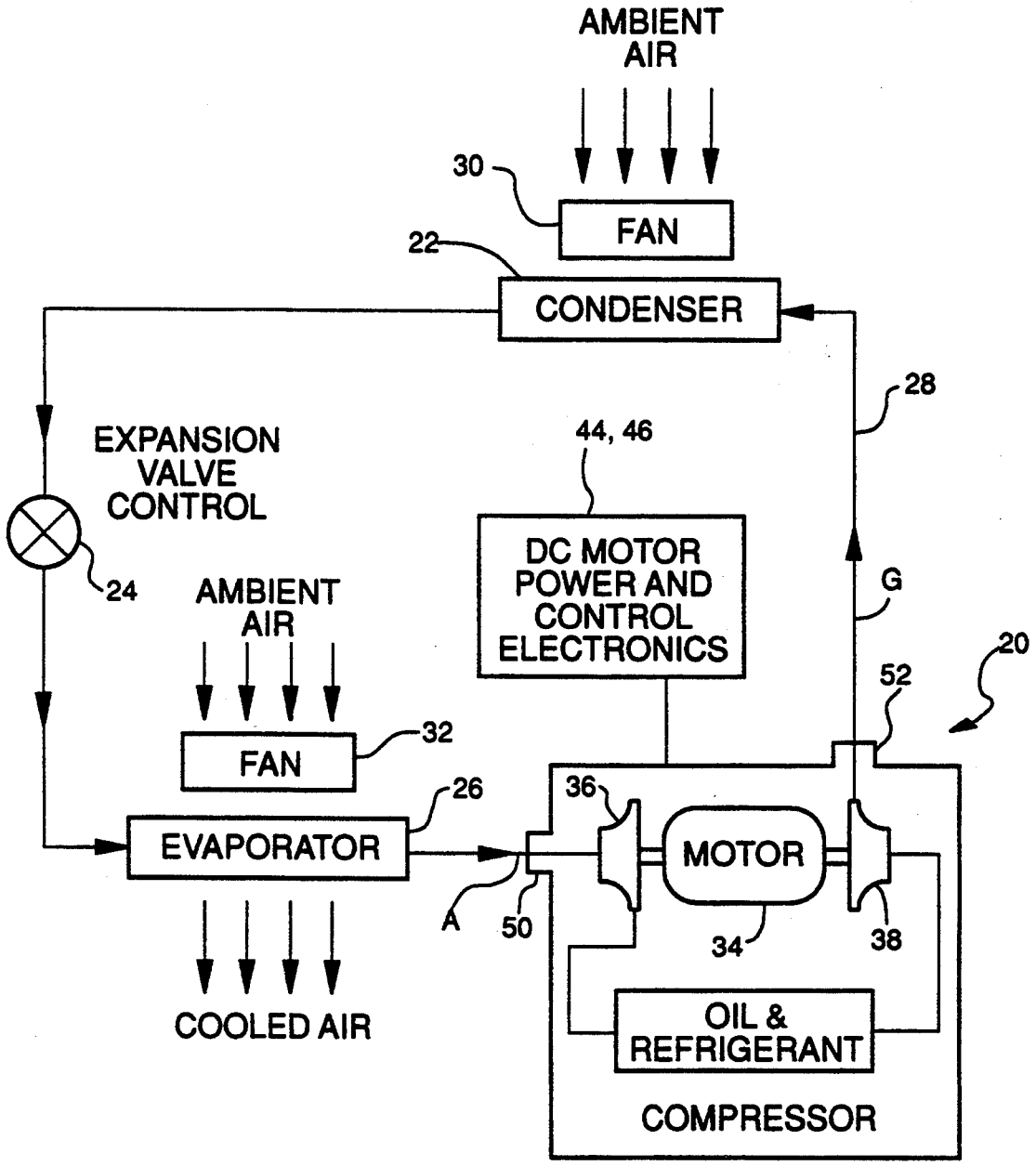
FIG. 2 is a simplified block diagram of a cooling system in which a mixture of lubricant and refrigerant are circulated through pathways within a compressor to lubricate and cool parts of the compressor.

Referring to FIG. 2, the compressor 20 is connected in series with a condenser 22, a control valve 24 and an evaporator 26 by a conduit 28. Fans 30, 32 direct the flow of air over the condenser 22 and evaporator 26.

As shown in FIG. 1, the compressor 20 is a fully integrated design, containing an electric motor 34, two impellers 36,38, bearings 40,42, a motor electronic control 44,46, a comprehensive cooling and lubrication system, hereinafter more fully described, and all compressor interstage ductwork assembled within a housing 48. The compressor internal flowpath is illustrated by arrows.

Motor 34 is a brushless D.C. motor that rotates centrifugal impellers 36,38. Preferably, the motor 34 is powered and controlled by electronics 44,46 and is operable from 48 to 320 volts D.C. Preferably, the speed of the motor 34 is variable over a predetermined range. Examples of suitable electronic control circuits are well known and can be found in MOTOROLA HANDBOOK, NO. DL128, entitled "Linear Interface Integrated Circuits."

With continued reference to FIG. 1, compressor 20 is a two stage centrifugal compressor having motor 34 mounted between two impellers 36,38. Within the compressor 20 there is more than one fluid pathway, between an inlet 50 and outlet 52. The pathways include concentrators 54,56 defined by a generally cone-shaped surface decreasing in diameter in the direction of flow to increase the concentration of lubricant in the mixture and to direct the concentrated mixture to the bearings 40,42 supporting the motor rotor.

A gaseous refrigerant mixture, including an entrained lubricant mist, enters the compressor 20 from the evaporator 26. The refrigerant mixture comprises a low pressure refrigerant, such as R113 or R225, of at least 90% of the mixture's volume and a lubricant, in the low pressure refrigerant, of at least 1% of the mixture's volume. Examples of other suitable refrigerants are the following Dupont products: Hydrofluorocarbon (HFC)—KCD 9472, Hydrochlorofluorocarbon (HCFC)—R225. The boiling points of these refrigerants is between 118° and 125° F. at standard atmospheric pressure. Examples of a suitable lubricant are mineral oils such as those supplied by Sun Oil Co. under the tradename "Sunniso-4GS." U.S. military specifications MIL-L-7808 and MIL-L-23699 describe other lubricants that are also suitable.

Figure 12:
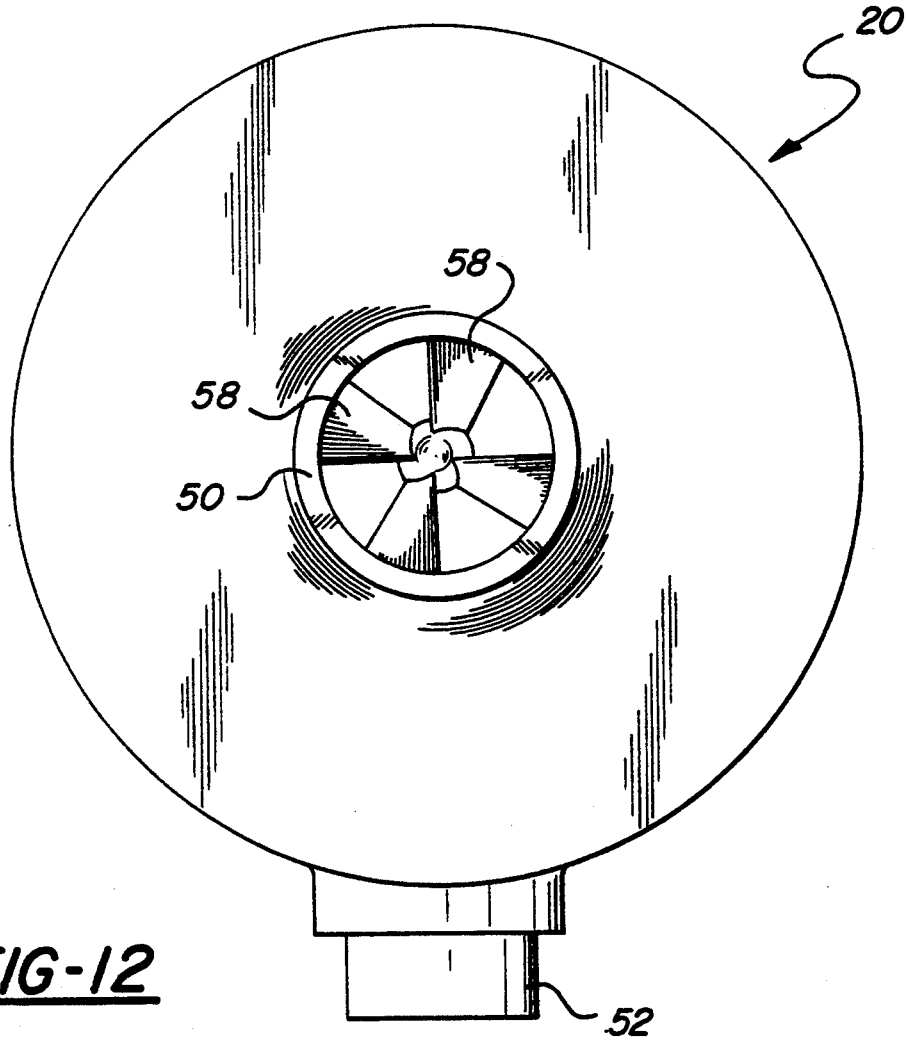
FIG. 12 is a plan view of the inlet of the centrifugal compressor.

Referring to FIGS. 1 and 3, the mixture flows along pathway A to inlet 50. An optional flow pre-swirler 58, best seen in FIG. 12, may be incorporated into the design in order to set up a satisfactory flow vector for the low pressure compressor impeller 36. The flow pre-swirler 58 increases the impeller 36 inducer blade setting angle so as to enable the impeller to be more readily removed from a plastic molding cavity.

Figure 4:
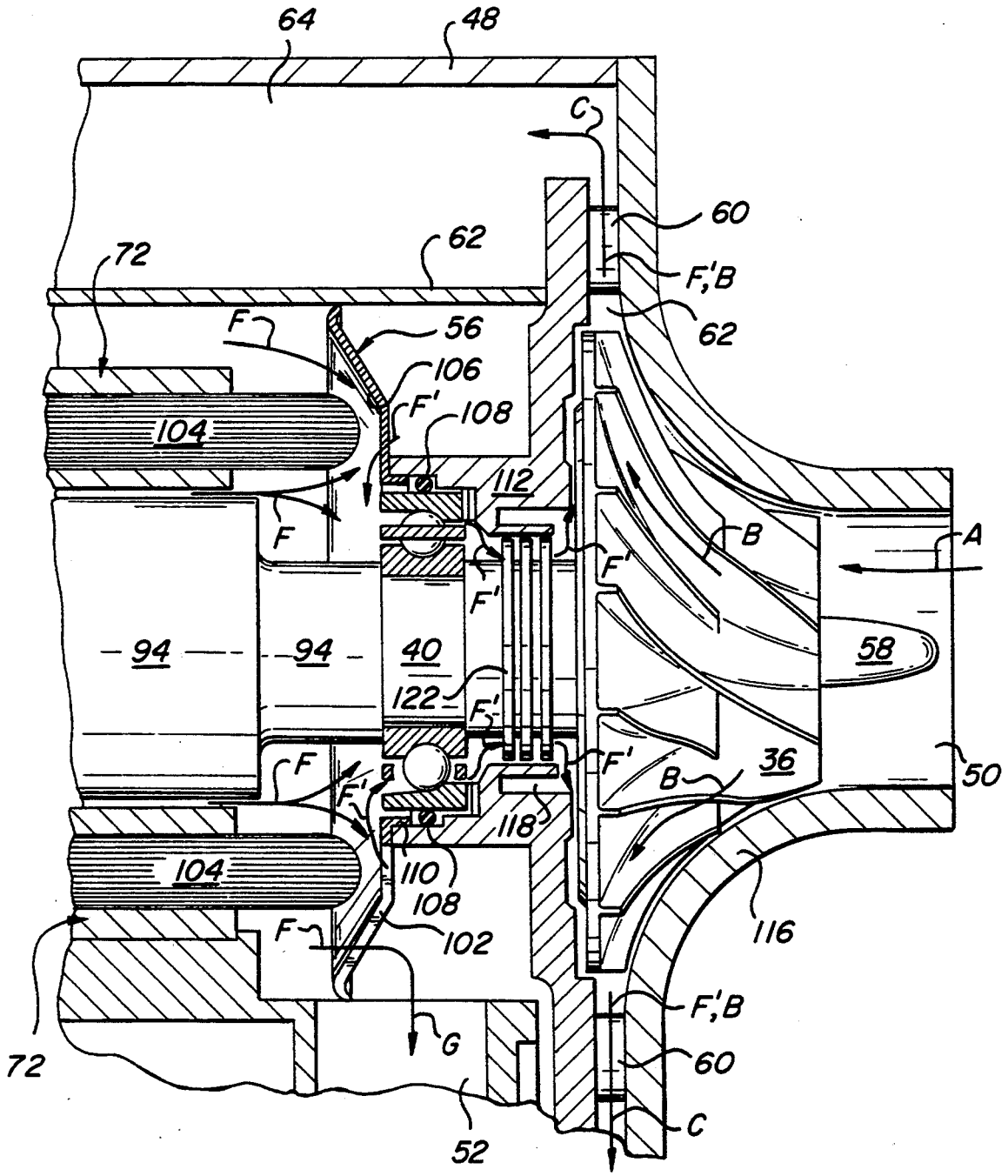
FIG. 4 is an enlarged partial cross-sectional view of a first stage of the centrifugal compressor shown in FIG. 1.

Intermediate pressure refrigerant gas exiting the low pressure impeller 36 along pathway B flows radially outward and combines with circulated flow F′ before passing through a short vaneless diffusion area 62, best seen in FIG. 4, and into a cascade-type diffuser 60. The cascade-type diffuser 60 may be used alternately with a channel-type diffuser, not shown, however, the cascade-type diffuser maintains higher efficiency over a wider flow range than a channel diffuser and can generally be employed within a shorter radius than the channel variety.

Flow leaving the low pressure cascade diffuser 60 along flowpath C then turns axially before flowing over the exterior of the motor stator housing 62 into passageway 64. The motor stator housing 62 is an aluminum or magnesium die casting to which six MOSFET or IGBT-type semiconductors 46 are attached. A low resistance thermal path from the semiconductors to the motor stator housing provides sufficient heat transfer area to permit the intermediate pressure flow exiting the low pressure impeller 36 to cool the semiconductors.

Use of the intermediate pressure flow along pathway C for the purposes of electronics cooling is advantageous for two reasons: 1) intermediate pressure flow is also at an intermediate temperature of approximately 90° to 110° F. High pressure flow can be as hot as 200° to 250° F. Use of lower temperature cooling gases greatly influences electronic component reliability. Since the gas mass flow is proportional to motor horsepower requirements and power dissipation by the electronics is directly proportional to motor horsepower, the amount of coolant varies proportionally with the heat rejection requirements of the electronics; and 2) heat dissipated by the electronics is ultimately rejected in the condenser along with other system inefficiencies and heat absorbed by the evaporator. Integrating the electronics heat rejection into the overall thermodynamic cycle reduces system mass, complexity and cost.

The intermediate pressure flow along pathway C also passes over a motor phase sequencing circuit board 44. This circuit board 44 does not have any specific cooling requirement but the internal electrical hookup is greatly simplified by incorporating this control within a hermetic outer housing 48.

Rotor position feedback to the motor phase sequencing board 44 is received from three hall-effect type sensors 68. These sensors 68 are located immediately behind the low pressure impeller 36 in this embodiment, but could be located behind the high pressure impeller 38 or in close proximity to any other suitable location near a rotating member. The hall effect sensors 68 are triggered by two or more small magnets 70 embedded in the back face of the low pressure impeller 36, 180 degrees apart, with opposing poles. In another embodiment, sense coils, not shown, are located in the motor stator 72 to monitor the main motor windings themselves for back electromotive forces from which rotor position can be logically discerned rather than using magnets and hall effect devices.

Intermediate pressure flow along pathway C leaves the environs of the electrical devices and turns radially inward at the opposite end of the compressor. This flow is collected and is fed into the high pressure impeller 38 via a low loss bellmouth feature. As the flow turns axially once again into the high pressure impeller 38 it encounters another optional flow pre-swirler 74. As was the case with the low pressure inlet pre-swirler 58, this feature can be instrumental in reducing high pressure impeller plastic mold tooling costs. Intermediate pressure gas, still containing entrained lubricant mist, passes through the high pressure impeller 38 and flows radially outward along pathway D and combines with circulated flow E' before passing through a short vaneless diffusion area 76, best seen in FIG. 5, before flowing into another cascade-type diffuser 78. The applicability of a channel diffuser as an alternative approach are equally valid at this location as hereinabove described.

Figure 5:
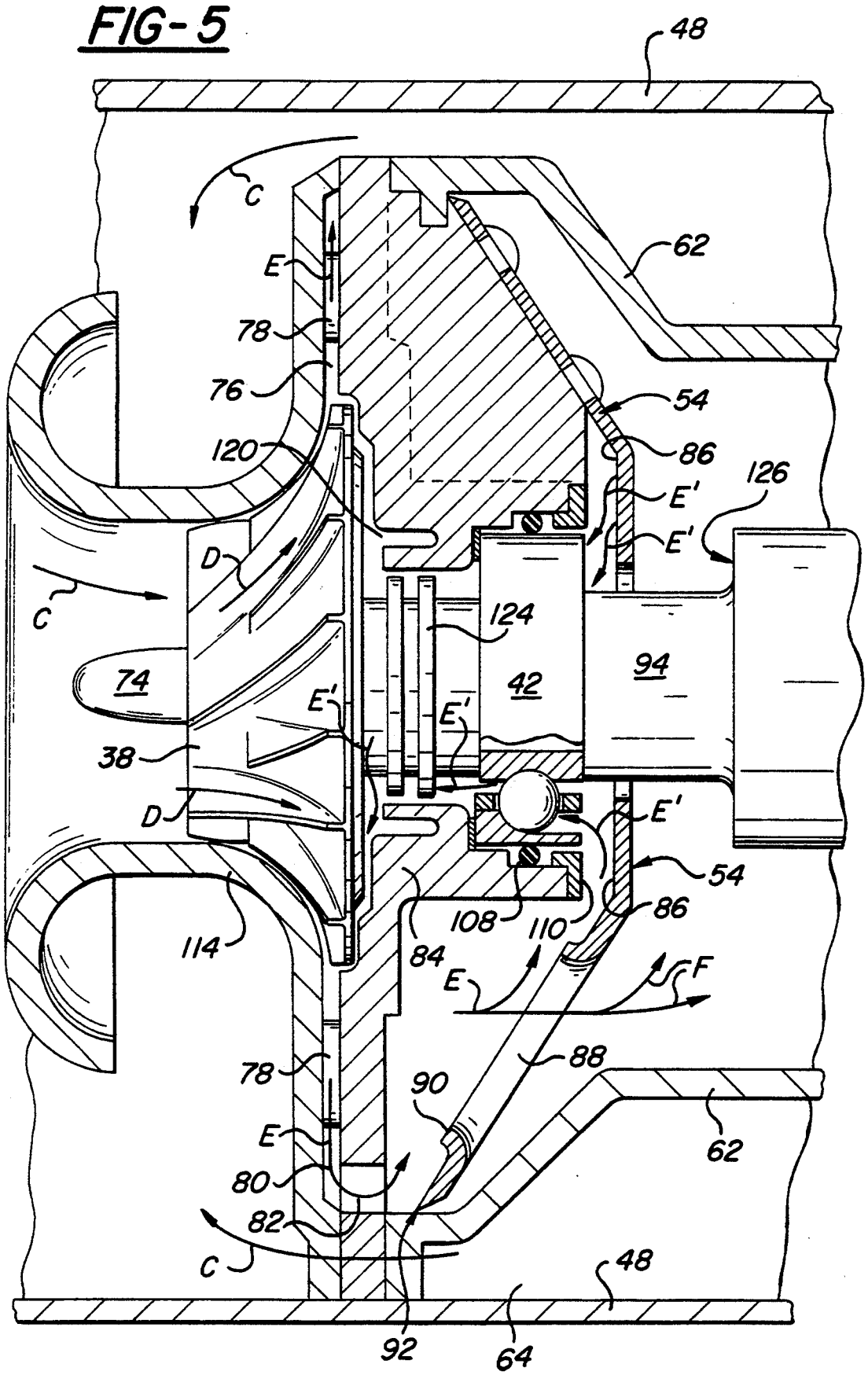
FIG. 5 is an enlarged partial cross-sectional view of a second stage of the centrifugal compressor shown in FIG. 1.
Figure 11:
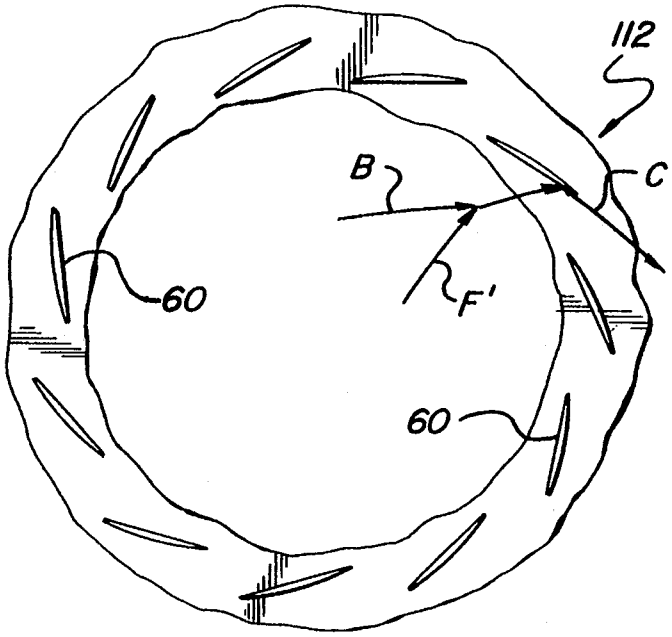
FIGS. 11 and 11A are plan and section views illustrating a diffuser element of the compressor that receives fluid flows and directs a resultant flow.
Figure 11A:
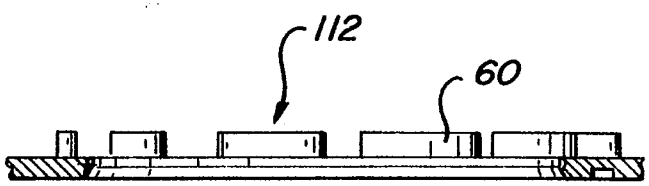
Figure 6:
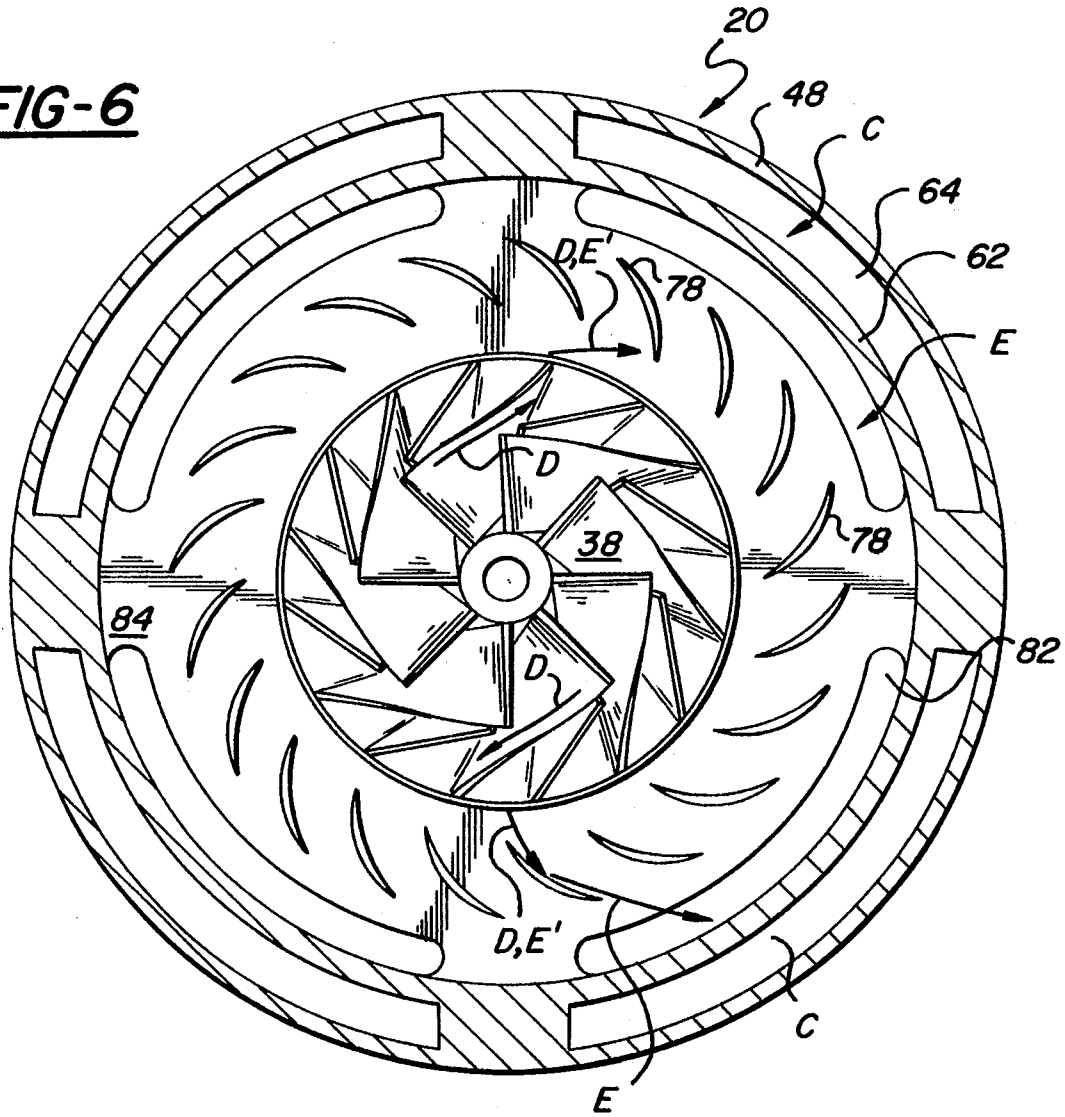
FIG. 6 is a sectional plan view taken along line 6—6 in FIG. 1 illustrating high pressure flowpath details in the compressor housing.
Figure 7:
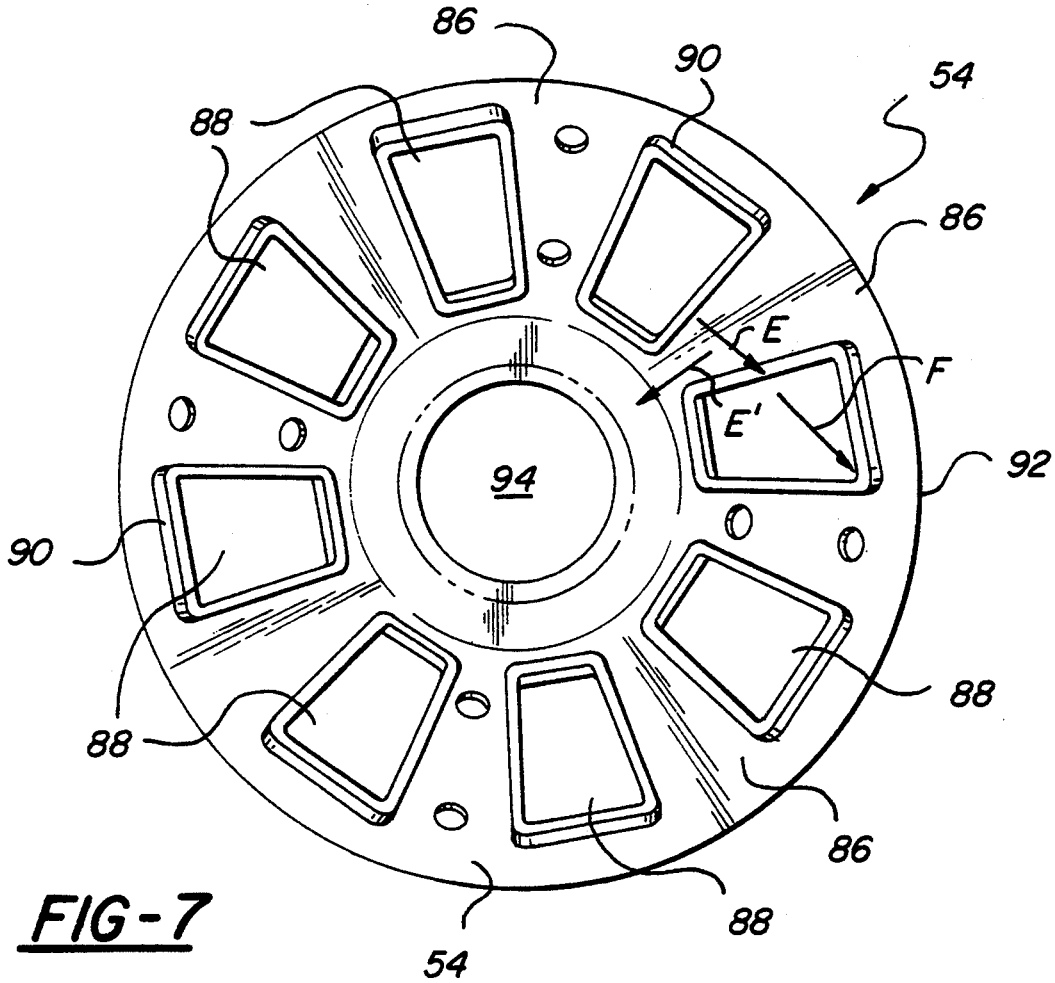
FIG. 7 is a plan view of a high pressure lubricant concentrator that redistributes lubricant to alter the concentration of lubricant in a portion of the mixture and directs that portion to the moving parts of the compressor.

Leaving the high pressure cascade diffuser 78 along pathway E, the high pressure gas with the entrained lubricant mist moves radially a short distance through an additional vaneless area 80 and is then forced to make another turn to an axial direction through passageway 82 best seen in FIG. 6. After completing this turn and passing through the high pressure bearing support 84, the high pressure gas is forced to turn abruptly, radially inward. The mixture, with its high inertial force, strikes a high pressure lubricant concentrator 54 on surface 86 as best seen in FIG. 5. Lubricant concentrator 54 causes some of the lubricant to coalesce on its surface 86 as the mixture impinges on the surface. The refrigerant mixture is subsequently communicated through lipped passages 88. Lipped passages 88 include a raised peripheral portion 90, best seen in FIG. 7. Raised peripheral portion 90 functions as a dam to prevent the coalesced lubricant from being reintroduced into the refrigerant flow and passing through passage 88. Instead, the coalesced lubricant flows along surface 86. Surface 86 is configured to direct the coalesced lubricant in a predetermined direction.

The mixture, now relieved of a portion of the entrained lubricant, continues along flowpath F through the lipped passageway 88 in the high pressure lubricant concentrator 54. The high pressure lubricant concentrator 54 has a tapered edge 92 which defines a relatively leak-free seal with the inside diameter of the motor stator housing 62. High pressure gas leaving the high pressure lubricant concentrator 54 is then directed axially through the motor stator housing 62 where it passes over the rotor shaft 94 and the motor stator 72 along pathway F.

Figure 8:
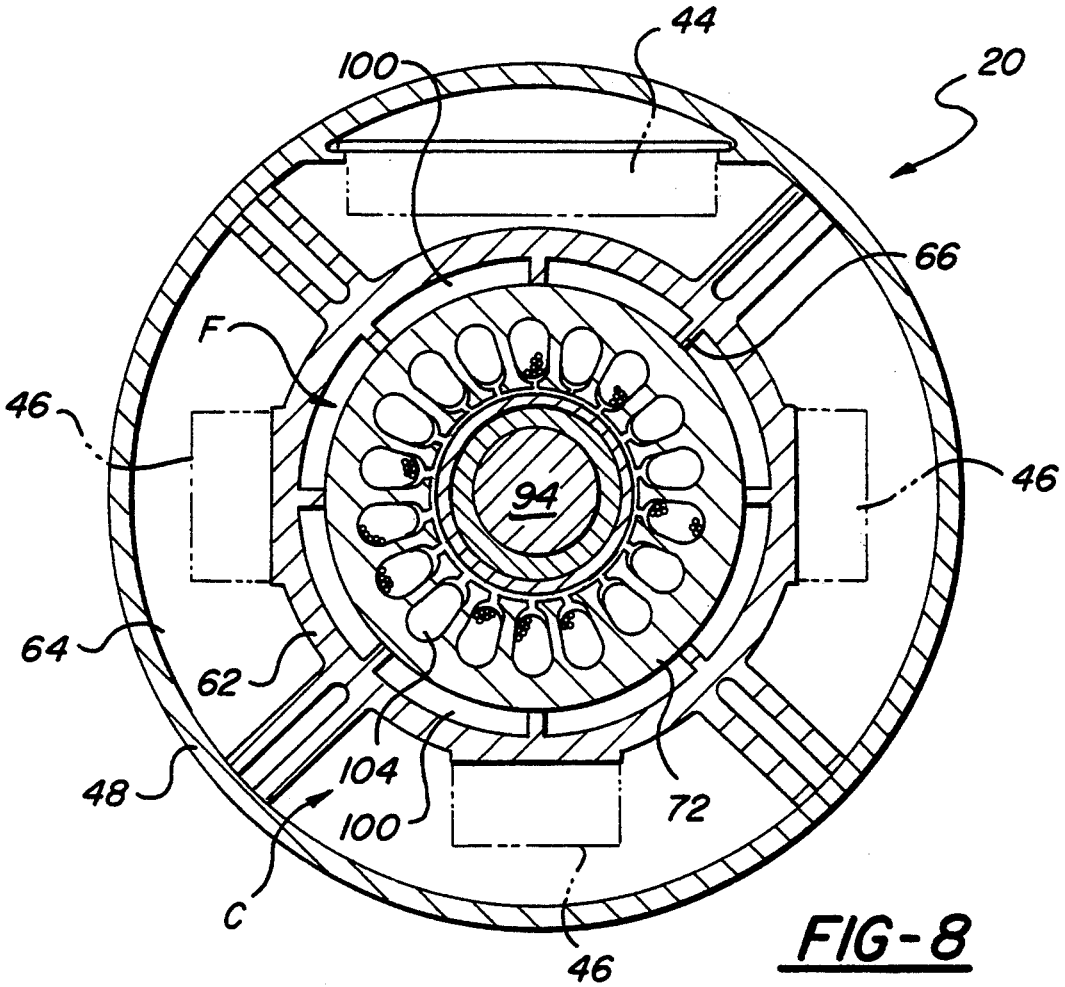
FIGS. 8 and 8A are cross-sectional views of a DC motor that drives the two stage centrifugal compressor.
Figure 8A:
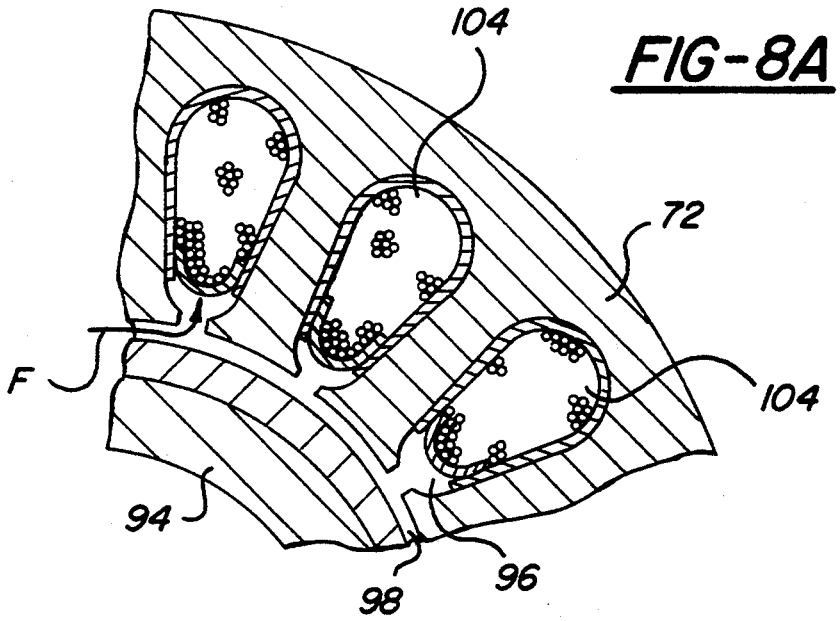

With reference to FIGS. 8 and 8A, there are three primary cooling flow passages 96, 98 and 100 for the stator 72 and the rotor 94; a passageway 100 over the stator outside diameter; a passageway 96 through the stator wire slots; and a passageway 98 through the stator bore. Passageways 96, 98 and 100 define convective paths for convective heat transfer. The convective path 98 through the stator bore also provides positive flow in the vicinity of the rotor shaft 94 to prevent build-up of windage heating. The stator windings are referred to by reference character 104 in FIGS. 1, 4, 8 and 8A to aid in describing the invention.

Figure 9A:
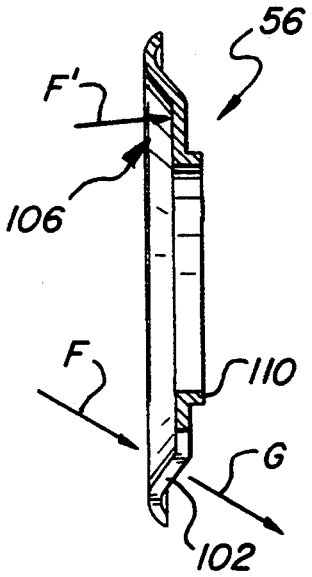
FIGS. 9 and 9A are plan and section views of a low pressure lubricant concentrator that redistributes lubricant to alter the concentration of lubricant in a portion of the mixture and directs that portion to the moving parts of the compressor.
Figure 9:
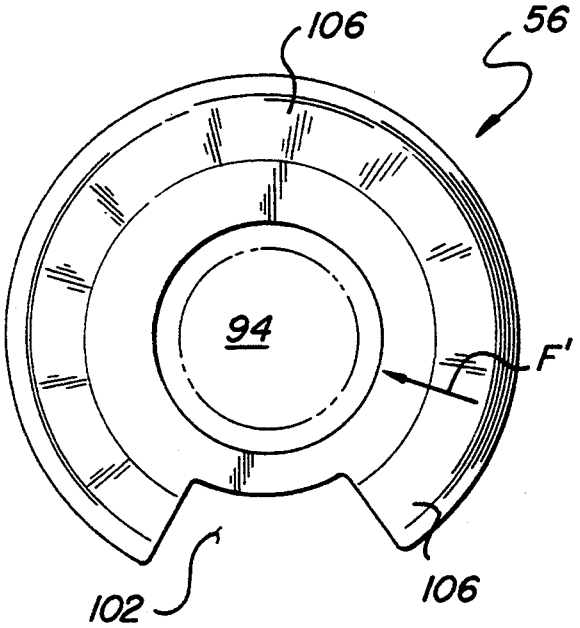

All flow exiting the stator area flows axially along pathway F to impact against the low pressure lubricant concentrator 56, best seen in FIGS. 1, 9 and 9A. An opening 102 in the low pressure lubricant concentrator 56 provides a clean path for the high pressure gas to exit the compressor 20. While the majority of the high pressure gas is again forced to turn at the low pressure lubricant concentrator 56 as it strikes surface 106, best seen in FIG. 9. A portion of the lubricant in the mixture coalesces on surface 106.

The rotor shaft 94 is supported by bearings 40 and 42. The present invention utilizes angularly loaded ball bearings. Alternatively, journal-type bearings, with a thrust feature at each bearing location to hold the shaft in position can be utilized. Each bearing 40,42 is supported by an elastomeric O-ring 108. In the absence of a high pressure lubricant source to provide viscous dampening of the bearing assemblies, these O-rings 108 serve to provide both a soft mount and dampening. In this embodiment, the shaft 94 operates at speeds which are above its two rigid body modes, bounce and rock, but below its first bend mode. The soft mounting provided by the twin O-rings 108 serves to significantly reduce the natural frequency of the two rigid body modes and therefore reduce the total available energy in the shaft system while exciting these modes during start acceleration.

O-rings 108 are effectively held in place by O-ring retainers 110, best seen in FIGS. 5 and 9A. In this embodiment, the clearance between the high pressure side bearing 42 outer diameter and the inside diameter of the high pressure side bearing support 84 and the low pressure side bearing support 112, respectively, is approximately 0.002–0.003 inches radially. In another embodiment of this invention, it would be possible to fashion the bearing supports of a sufficiently low elastic modulus material and incorporate features in the vicinity of the bearings so as to achieve the desired spring rate in the support. This would eliminate the O-rings 108 and the O-ring retainers 110 and permit the bearings to be pressed into the bearing supports in a more conventional manner.

In the present invention, the shaft 94 position, along with the proper bearing angular preload, is established through the use of two shims and a wave or belleville-type spring. As the high pressure impeller 38 is the more sensitive, in terms of efficiency, to the relative clearance between itself and the shroud 114 surrounding it, this clearance is established at initial assembly using a conventional shim in an axial location between the high pressure side bearing 42 and high pressure side bearing support 84. A conventional bearing preload spring is then located in an axial pocket between the low pressure side bearing 40 and the low pressure bearing support 112. The face clearance between the low pressure impeller 36 and the low pressure impeller shroud 116 surrounding it is established by a conventional shim.

Figure 10:
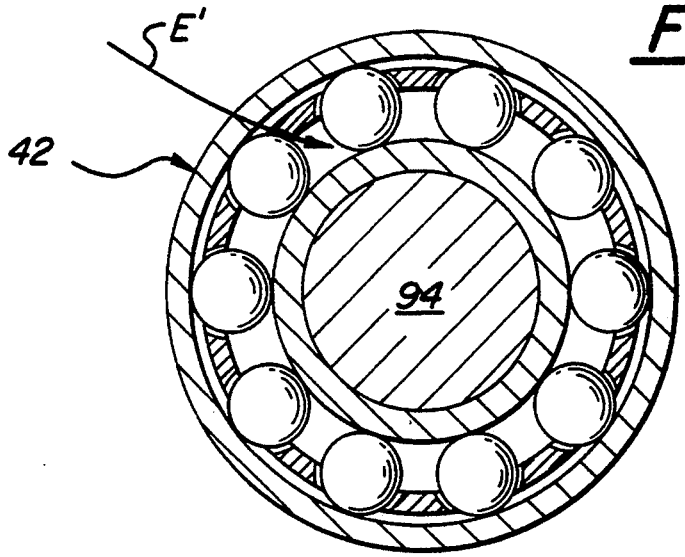
FIG. 10 is an enlarged sectional view of a bearing assembly for the motor rotor shown in FIG. 1.

Bearing cooling and lubrication is provided by means of controlled leak pathways F' and E' through the respective bearings 40,42 from the interior of the motor stator housing to the respective low pressure areas 118,120 found near the impeller hubs at their respective backface. Flow through the bearings 40,42 is controlled by non-contacting labyrinth flow restrictors 122,124 located on the low and high pressure impeller hubs. Lubrication of the high pressure bearing 42 is provided as lubricant is entrained along pathway E' down the surface 86 of the high pressure lubricant concentrator 54 and introduced to the leakage flow-field present at the face of the high pressure bearing 42. Refrigerant mixture flow, pathway E', along with entrained lubricant droplets pass through the bearing 42, providing lubrication, while the refrigerant gas provides convective cooling for the bearing, as best seen in FIG. 10.

Lubricant and refrigerant flow along flowpath E' exit through the labyrinth flow restrictor 124 and are pumped out via the high pressure impeller 38 backface to rejoin the main flowpath D. Lubricant bypassing the high pressure lubricant concentrator 54 along flowpath F through the lipped passageways 88 remains entrained in the high pressure gaseous flow stream passing through the stator proper. In addition, excess lubricant, not trapped by the high pressure bearing 42 cooling flow-field, spills to the downstream side of the high pressure lubricant concentrator 54 at its inside diameter near the rotor-shaft 94. A shoulder 126 on the rotor shaft 94 provides the pumping action necessary to reintroduce this lubricant to the main flow, pathway F, of high pressure refrigerant traversing the stator proper.

The low pressure lubricant concentrator 56, seen in FIGS. 1 and 4, works in a similar manner to high pressure lubricant concentrator 54, to funnel entrained lubricant to the vicinity of the low pressure bearing 40 cooling flow-field. Again, this mixture of high pressure refrigerant and entrained lubricant flows through the low pressure bearing 40, along flowpath F', out the labyrinth flow restrictor 122 and radially outward on the backface of the low pressure impeller 36 to rejoin the refrigerant flow along flowpath B. The velocity gradients present within the compressor 20 are such that no lubricant puddling will occur. With proper cooling flow, lubricant flow rates as low a 4 ounces/-hour/bearing have been found to provide sufficient lubrication.

The temperature gradients within the compressor 20 are such that temperatures in excess of 230° F. are rarely encountered. Cycle temperatures coupled with cycle pressures, typically below 30 psia, permit extensive use of plastics as materials of construction. The only metallic components envisioned at this time include the motor stator housing 62, the rotor shaft 94, the bearings 40,42 (if ball bearings are used), and the magnetic circuit paths of the motor stator 72. Preferably, the housing 48,116 is entirely of plastic construction with the exception of the electrical power and control leads exiting the housing.

Figures 13, 14, 15:
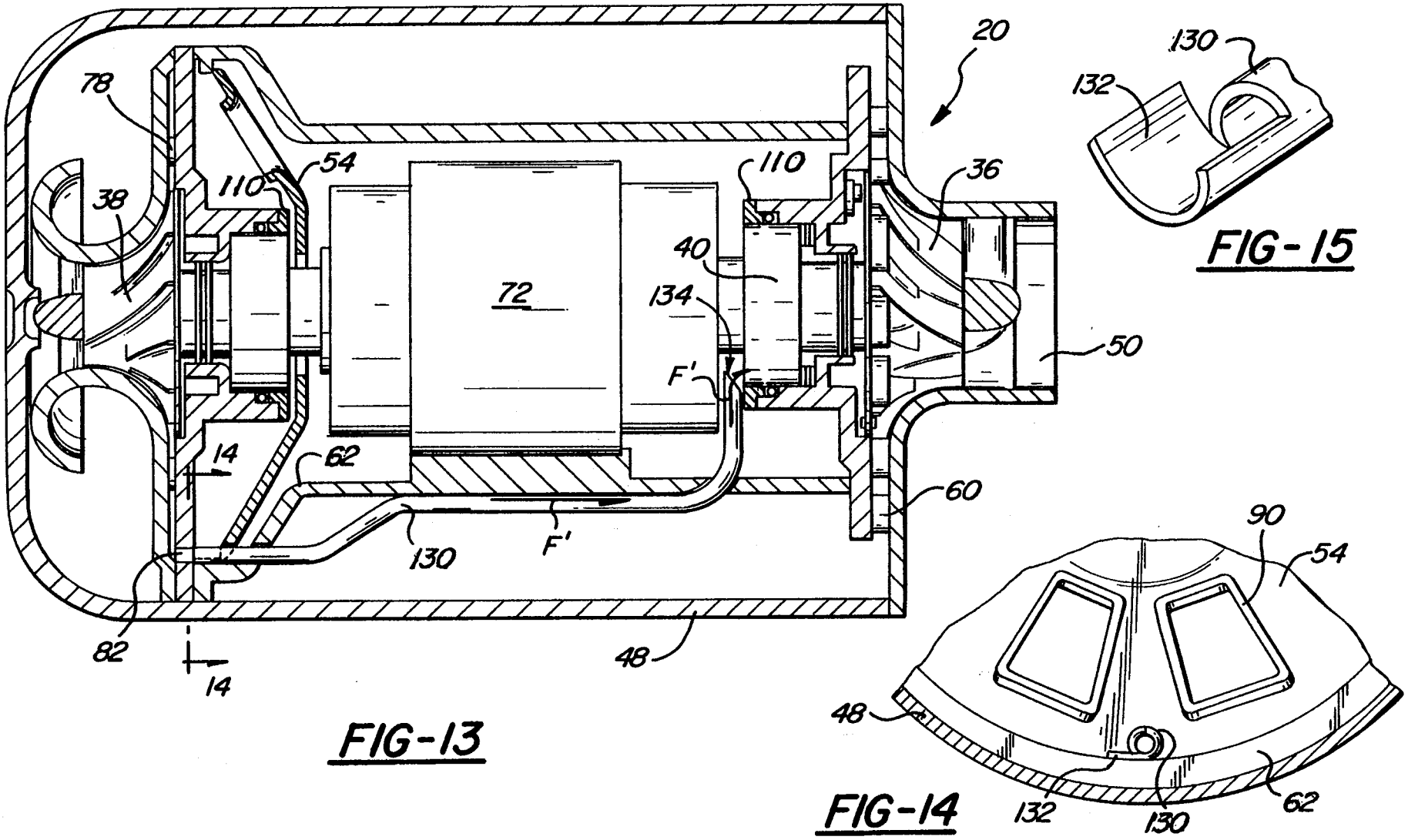
FIG. 13 is a diagrammatic cross-sectional view of the two stage centrifugal compressor or FIG. 1 constructed in accordance with an alternative embodiment of the present invention and illustrating a blast tube protruding through a high pressure lubricant concentrator for receiving and communicating lubricant therethrough.
FIG. 14 is a sectional plan view of the high pressure lubricant concentrator of FIG. 7 illustrating the arrangement of the blast tube protruding therethrough.
FIG. 15 is a sectional perspective view of the end of the blast tube that extends through the high pressure lubricant concentrator illustrating its construction for collecting coalesced lubricant.

In FIGS. 13–15, an alternative embodiment of compressor 20 is illustrated. Therein, similar structure to the above-discussed embodiment is referred by similar reference characters. In this embodiment, flow progresses through inlet 50, the low pressure compressor 36 and diffuser 60, into an through the high pressure compressor 38 and diffuser 78, and completes the turn from a radial to an axial direction as described previously. Flow exiting the passages 82 in an axial direction still retains some tangential swirl component from the high pressure diffuser 78.

A portion of lubricant entrained by the refrigerant and centrifugally enriched, tends to rotate in a circumferential eddy near the tapered edge of the high pressure lubricant concentrator 54. A blast tube 130 protrudes through the high pressure lubricant concentrator 54, best seen in FIG. 14. Blast tube 130 contains a ramp feature 132, best seen in FIG. 15, which causes lubricant rotating in this eddy to be conducted into the blast tube 130. Blast tube 130 extends to the vicinity of the low pressure bearing 40 where a miter formed at its end 134 causes the lubricant/refrigerant mixture to exit the tube 130 at an angle conducive for admittance into the low pressure bearing 40.

Lubricant and refrigerant passing through the low pressure bearing 40 continues on the previously disclosed pathway. In order to increase the effectiveness of the blast tube 130, it is usually necessary to further restrict the flow area around the motor stator 72 to achieve the desired flow balance between the motor stator cooling flow and the blast tube flow. The high pressure lubricant concentrator 54 remains unchanged except for the hole where the blast tube 130 penetrates it. The bearing O-ring retainer 110 utilized in the hereinabove described embodiment at the high pressure bearing 42 is utilized to retain the O-ring 108 at the low pressure bearing 40 as well. The low pressure lubricant concentrator 56 is eliminated in this embodiment.

While the best mode for carrying out the invention has been described in detail, those familiar with the art to which this invention relates will recognize various alternative designs and embodiments for practicing the invention as defined by the following claims.

What is claimed is:

1. An improved motor driven centrifugal refrigerant compressor having a housing, a motor, control electronics for the motor and moving parts, said housing enclosing said motor, control electronics for the motor and moving parts of the compressor and also including an internal fluid pathway for circulating a refrigerant-/lubricant mixture, said pathway including a restrictive surface including an opening, interposed in said pathway and in communication with said pathway, wherein lubricant in said mixture impinging on said surface is coalesced into a concentrated stream said pathway also including means for convective heat transfer in communication with said motor and control electronics whereby said motor and electronics are cooled by the circulating refrigerant mixture.

2. The improved refrigerant compressor of claim 1 said convective heat transfer means is a region of extended area in said fluid pathway wherein the refrigerant in said mixture transports heat.

3. The improved refrigerant compressor of claim 2 wherein said region of extended area is a fin projecting into said pathway.

4. The improved refrigerant compressor of claim 2 wherein said refrigerant mixture comprises a low pressure refrigerant of at least 90% of the mixture's volume and a lubricant of at least 1% of the mixture's volume.

5. The improved refrigerant compressor of claim 4 wherein the lubricant is miscible in the refrigerant.

6. The improved refrigerant compressor of claim 4 wherein the compressor is a two-stage compressor having the motor mounted between said stages.

* * * * *